United States Patent [19]

Scalise et al.

[11] Patent Number: 4,879,932

[45] Date of Patent: Nov. 14, 1989

[54] MANUALLY OPERABLE PAPER SLITTING DEVICE AND METHOD

[76] Inventors: William J. Scalise; Donna J. Scalise, both of 10119 Stonell, St. Louis, Mo. 63123

[21] Appl. No.: 176,426

[22] Filed: Apr. 1, 1988

[51] Int. Cl.[4] ..... B26F 1/18

[52] U.S. Cl. ..... 83/30; 83/142; 83/564; 83/599; 30/234; 281/5

[58] Field of Search ..... 83/30, 142, 564, 589, 83/557, 644, 660, 599, 467 R; 30/279, 305, 234; 281/2, 5

[56] References Cited

U.S. PATENT DOCUMENTS

| | | | |
|---|---|---|---|
| 151,723 | 6/1874 | Sigwalt | 83/599 X |
| 436,048 | 9/1890 | Valiquet | 83/142 |
| 3,408,889 | 11/1968 | Murphy | 83/599 |
| 3,484,097 | 12/1969 | Jory | 281/5 UX |
| 3,517,871 | 6/1970 | Gaffney et al. | 83/564 X |
| 4,194,423 | 3/1980 | Cutler | 83/564 X |

*Primary Examiner*—Donald R. Schran

*Attorney, Agent, or Firm*—Polster, Polster & Lucchesi

[57] ABSTRACT

A manually operable paper slitting device has upper and lower platens normally biased apart from one another. The upper platen has diagonally extending and spaced parallel slitting blades extending downwardly therefrom for cooperation with spaced complementary slots formed in the lower platen. A resilient and compressible paper hold down and stripper element extends downwardly from the upper platen in surrounding relationship to the spaced slitting blades. The spaced slitting blades have an inclined bottom cutting edge which first pierces and then permits slitting of the paper along the cooperating slots in the lower platen. The resilient and compressible paper hold down and stripper element holds the paper from moving during and after the slitting operation. In addition to the aforementioned device, a method of forming diagonally extending parallel slits in paper applies resilient and compressive hold down forces on opposite sides of aligned and squared paper and in surrounding relationship to the area of the paper to be slit. The paper is slit along spaced diagonally extending slits by first piercing and then slitting the paper, and finally the paper is stripped from the slitting blades following the slitting operation.

5 Claims, 2 Drawing Sheets

MANUALLY OPERABLE PAPER SLITTING DEVICE AND METHOD

BACKGROUND OF THEI NVENTION

The present invention relates to manually operable paper slitting devices, and more particularly, to manually operable paper slitting devices for slitting diagonally extending and spaced parallel slits in paper for the insertion of a business card or the like therein, and to the method of forming diagonally extending and spaced parallel slits in paper.

Business people typically use business cards to identify themselves and the company/organization with which they are affiliated. In direct face-to-face meetings, business cards provide a convenient reminder of each person's name and company/organization. Business people also sometimes send their business card with correspondence, reports, product literature and other documents. In most cases, the business card is attached by a staple or paperclip to the document. Neither of these fastening techniques encourage the removal of the business card from the other documents for convenient reference.

In addition to stapling or "paper-clipping" business cards to documents, it is also possible to form diagonally extending and spaced parallel slits in paper, cardboard, etc. which are suitably sized to receive opposite ends of a business card for insertion therein. At least one company, Jilcraft, Inc. of Peabody, Mass., is making and selling "Inserta-Card TM" business communication cards having diagonally extending and spaced parallel slits into which a business card can be inserted. These business communication cards, which can be purchased by the user to send to customers, suppliers and others, are themselves a separate document requiring either a separate mailing or must be enclosed as an additional document with other documents in the same mailing. Unfortunately, these separate business communication cards do not provide the convenience of inserting the business card within diagonally extending and spaced parallel slits in specific literature or other documents, unless one takes the time to make their own slits for business card insertion. Obviously, no one will repeatedly make such business card slits in documents to be sent to others without looking for a more efficient method and device to perform this slitting operation.

SUMMARY OF THE INVENTION

Among the several objects and advantages of the present invention are the provision of a manually operable paper slitting device for slitting diagonally extending and spaced parallel slits in paper documents for the insertion of a business card therein.

A second object is the provision of such a slitting device which affords the convenient option of forming business card slits in paper documents in the office environment.

A third object is the provision of such a slitting device which is manufactured as a desk-mounted unit for accurate, efficient and effective slitting of a variety of documents as may be desired by the user.

A fourth object is the provision of such a slitting device which employs a resilient and compressible paper hold down and stripper element for not only holding paper during the slitting operation and stripping of the paper following slitting, but which also surrounds and protects slitting blades from damage.

A fifth object is the provision of such a slitting device which is simple and easy to construct and operate, utilizes a minimum number of parts, is economical, requires little or no maintenance, and is otherwise well adapted for the purposes intended.

A sixth object is the provision of a manually operable method of forming diagonally extending and spaced parallel slits in paper documents.

Briefly stated, the manually operable paper slitting device of the present invention includes first and second platens having spring means interposed therebetween for normally biasing the platens away from each other. The first platen is provided with spaced slitting blades extending from the first platen toward the second platen and cooperating with spaced complementary slots formed in the second platen when the platens are moved toward each other. A resilient and compressible paper hold down and stripper element extends from the first platen toward the second platen and surrounds the spaced slitting blades. The resilient compressible paper hold down and stripper element extends past the spaced slitting blades and is spaced from the second platen when the first and second platens are in an at rest position to allow paper to be inserted into the space therebetween. The resilient and compressible paper hold down and stripper element is compressed to hold the paper from moving during and after the slitting operation when a predetermined force is applied to one of the platens. The spaced slitting blades have an inclined cutting edge to enable a portion of the slitting blade to first pierce and then permit remaining portions of each inclined cutting edge to slit the paper along the cooperating slots formed in the second platen upon the continued application of predetermined force to said one of the platens.

The manually operable method of forming diagonally extending and spaced parallel slits in paper comprises the steps of: positioning paper to be slit in aligned and squared orientation relative to a guide surface, applying resilient and compressive hold down forces on opposite sides of the paper to be slit and in surrounding relationship to the area of the paper to be slit, slitting the paper along diagonally extending and spaced parallel slits relative to the squared and oriented paper by first piercing and then slitting the paper along each of said diagonally extending and spaced parallel slits by means of a pair of slitting surfaces, and thereafter stripping the paper from the slitting surfaces following the aforementioned slitting operation.

Other objects and features of this invention will become apparent from the description that follows.

BRIEF DESCRIPTION OF THE DRAWINGS

Corresponding reference numerals will be used throughout the various figures of the drawings.

DESCRIPTION OF THE PREFERRED EMBODIMENT

Figure 7:
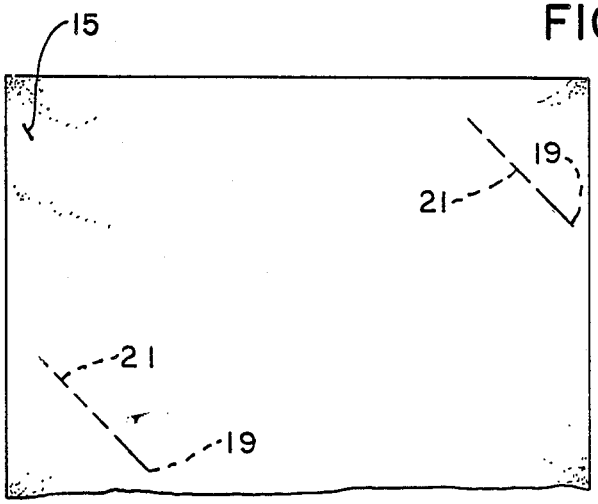
FIG. 7 is a fragmentary top plan view illustrating the initial piercing and subsequent slitting of a pair of diagonally extending and spaced parallel slits.
Figure 8:
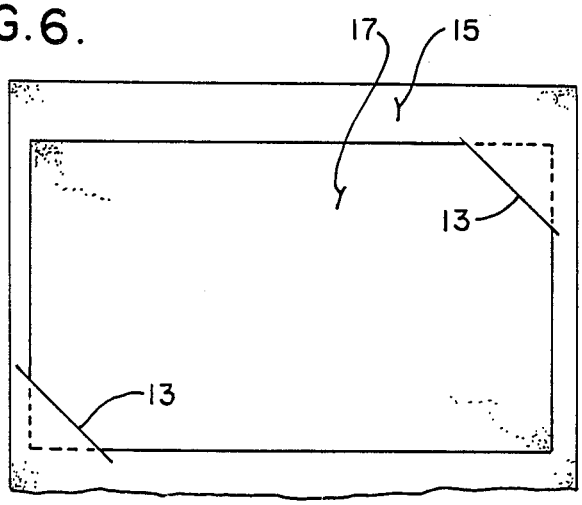
FIG. 8 is a fragmentary top plan view illustrating a business card having opposite corners inserted into the diagonally extending and spaced parallel slits formed in paper document.

The manually operable paper slitting device 11 shown in FIGS. 1–6 of the drawings is constructed to preform a slitting operation, which forms a pair of generally diagonally extending and spaced parallel slits 13, 13 in a paper documen 15 as shown in FIG. 8 of the drawings. Opposite corners of a business card 17 may then be inserted into the diagonally extending and spaced parallel slits 13, 13. Thus, a business card 17 can be conveniently mounted to a paper document 15, and readily and quickly removed therefrom, when desired. The slitting operation, to be described in conjunction FIGS. 1–6 of thedrawings, first pierces th paper 15 as shown in FIG. 7 at spaced locations 19, 19 and then permits complete slitting along the phantom lines 21, 21 in FIG. 7 of the drawings, representing the entire area to be slit in forming the diagonally extending and spaced parallel slits 13, 13 in FIG. 8.

In this application it is to be understood that the term "paper" or "paper document" includes a single sheet of paper or multiple sheets of paper or paper having various shapes, sizes and thickness, including cardboard or corrugated sheets. Also, the shape, size and location of the diagonally extending and spaced parallel slits 13, 13 may be varied to suit the particulars desired. In a similar way, the overall size, shape, appearance and material used (metal, plastic, composite, etc.) in the manufacture of the manually operable paper slitting device 11 may also be varied, without changing the essential features and operation of the manually operable paper slitting device 11 and related method of the present invention.

Figure 1:
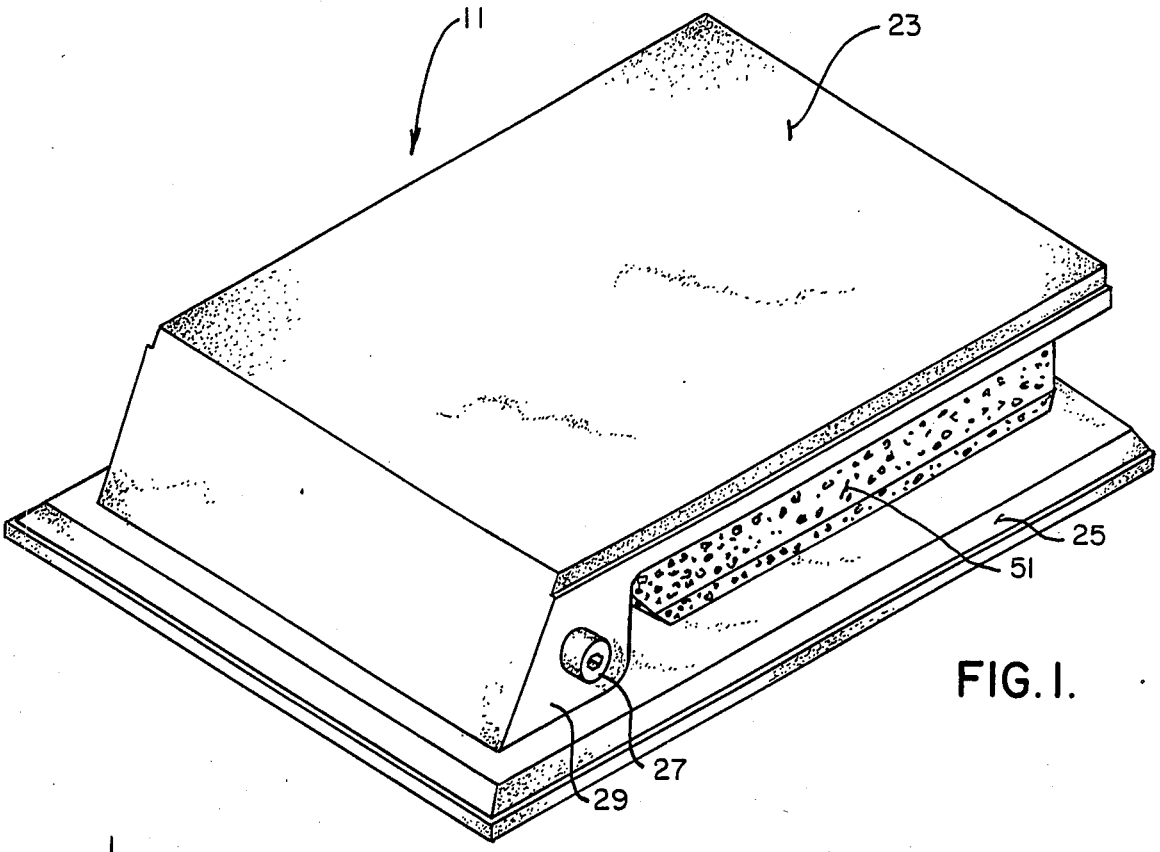
FIG. 1 is a rear perspective view of a manually operable paper slitting device constructed in accordance with the teachings of the present invention.
Figure 2A:
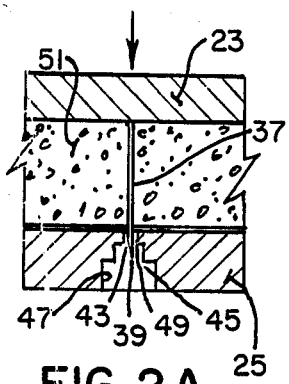
FIG. 2A is a fragmentary sectional view as viewed along lines 2A—2A of FIG. 2.
Figure 2B:
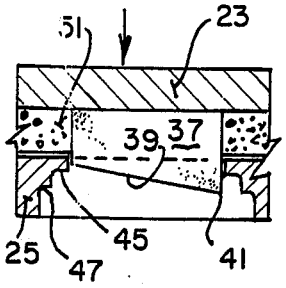
FIG. 2B is a fragmentary sectional view as viewed along lines 2B—2B of FIG. 2.
Figure 2:
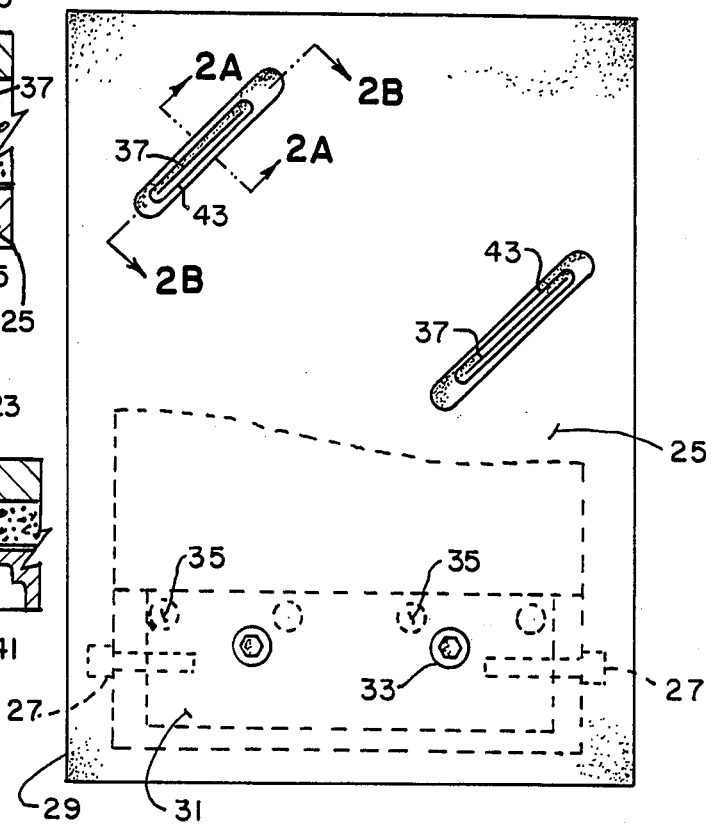
FIG. 2 is a bottom plan view of a lower platen of the manually operable paper slitting device of FIG. 1 illustrating the slitting blades and slots which cooperate in producing generally diagonally extending and spaced parallel slits into which a business card is inserted, as shown in FIG. 8.
Figure 3:
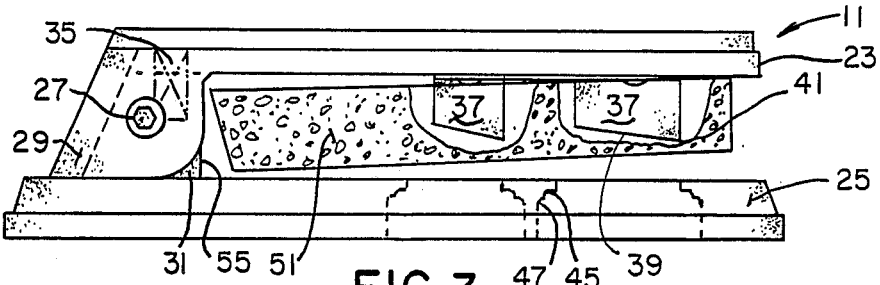
FIG. 3 is a side elevational view, with parts broken away for clarity, of the manually operable paper slitting device of FIG. 1 showing the at-rest position of the upper and lower platens in spaced relationship from one another.

The manually operable paper slitting device 11 includes upper and lower platens 23, 25 which are pivotally hinged together by pins 27 as seen in FIGS. 1–6 of the drawings. The pins 27 extend through hinges 29 which depend from the upper platen on opposite sides thereof and then through an upstanding boss 31 attached to the lower platen 25 by the threaded fasteners 33 as shown in FIG. 2. A series of spaced coiled springs 35 are received within the upstanding boss 31 of the lower platen 25 and engage the undersurface of the upper platen 23 in order to normally bias the upper and lower platens 23, 25 respectively away from one another as best seen in FIG. 3 of the drawings. When a predetermined amount of force is exerted on the upper platen 23, as shown for example in FIGS. 4–6 of drawings, the upper platen 23 is pivotally mounted about the pins 27 for movement to and away from the lower platen 25, as will be readily appreciated. Various types of components, springs and constructions are available to normally bias the upper and lower platens 23, 25 away from one another to their normal at-rest position, as will be appreciated.

A pair of spaced slitting blades 37, 37 extend downwardly from the upper platen 23 and are sized, positioned and arranged to form the diagonally extending and spaced parallel slits 13, 13 in the paper document 15 as shown in FIG. 8 of the drawings. Each of the cutting blades 37 has an inclined bottom cutting edge 39 with a lowermost portion 41 at the lowermost corner of each blade. This lowermost portion 41 first pierces the paper document as at 19, 19 in FIG. 7 before complete slitting of the slits 13, 13. To assist in the slitting operation, the lower platen 25 has complementary slots 43, 43 which are constructed to receive the slitting blades 37, 37 therethrough as will be discussed in connection with FIGS. 3–6 of the drawings. Each of the cooperating complementary slots 43, 43 (as best shown in FIGS. 2, 2A and 2B of the drawings) includes an elongated slot corresponding in size and shape to the slitting blades 37, 37 adjacent the upper surface of the lower platen 25. A series of progressive enlarged and relieved areas open up outwardly and downwardly therefrom as at 45 and 47 to facilitate forming of the cooperating complementary slots 43, 43 as well as provide blade protection.

It will be noted that the cutting blade 37 may be positioned in close proximity to one edge portion 49 of each of the complementary slots 43 in order to permit the side of each slitting blade 37 to engage the inner edge portion 49 for a combined slitting and shearing action on paper inserted in the device 11. In most situations however, the slitting blades 37 and cooperating complementary slots 43 are configured, arranged and positioned relative to one another in order to allow the slitting blades 37 to freely move through the cooperating complementary slots 43 for slitting action relative to paper documents inserted therebetween.

A resilient and compressible paper hold down and stripper element 51 extends downwardly from the lower face of the upper platen 23 and surrounds the spaced slitting blades 37, 37 as best seen in FIG. 3 of the drawings. The resilient and compressible paper hold down and stripper element 51 is formed from a resilient, open-cell foamed rubber structure which provides both resiliency and compressibility. The resilient and compressible paper hold down and stripper element 51 not only surrounds the slitting blades 37, 37, but extends below the spaced slitting blades 37, 37 in order to protect the blades against damage. When the upper and lower platens 23, 25 are in an at-rest position as shown in FIG. 3, the lower surface of the resilient and compressible hold down and stripper element 51 is spaced upwardly from the lower platen 25 in order to allow paper to be inserted into the space between the resilient and compressible paper hold down and stripper element 51 and the lower platen 25.

Figure 4:
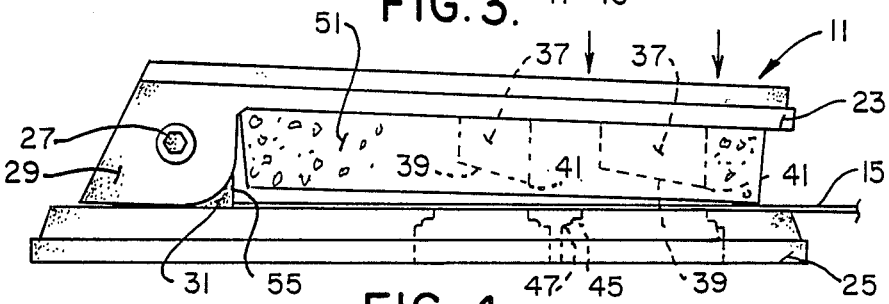
FIG. 4 is a side elevational view illustrating movement of the upper platen relative to the lower platen in order to enable resilient and compressible paper hold down and stripper means to hold down paper during and after the slitting operation.
Figure 5:
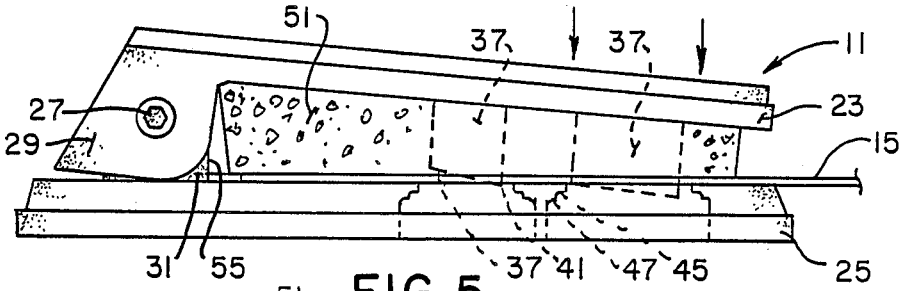
FIG. 5 is a side elevational view showing further movement of the upper platen relative to the lower platen in which cutting blades mounted to the upper platen initially pierce the paper prior to complete slitting along the diagonally extending and spaced parallel slits.
Figure 6:
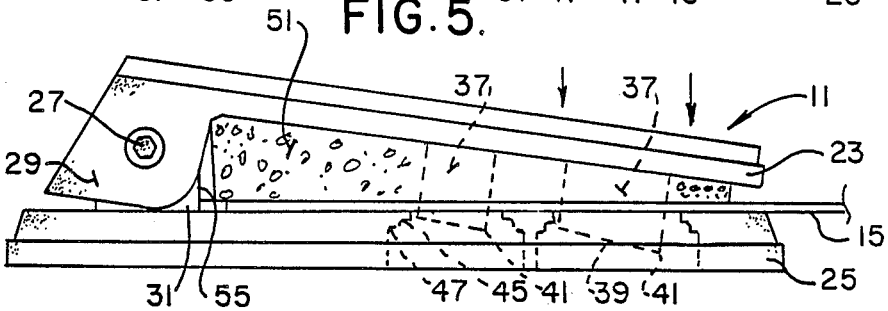
FIG. 6 is a side elevational view showing complete interfitting movement of the upper platen relative to the lower platen in which the slitting blades slit the paper through cooperating slots in the lower platen.

In use, when a predetermined force is downwardly applied against the upper platen 23, by hand pressure, as represented by the arrows shown in FIG. 4 of the drawings, the resilient and compressible paper hold down and stripper element 51 engages a paper document prior to and during the slitting operation, in order to prevent any shifting of the paper. Furthermore, since the resilient and compressible paper hold down and stripper element 51 surrounds each of the slitting blades 37, 37, corresponding surrounding portions of the resilient and compressible paper hold down and stripper element 51 will engage the paper in surrounding relationship to the area of the paper to be slit. This surrounding engagement holds and supports the paper in fixed and supported position over each of the corresponding complementary slots 43, 43 in the lower platen 25. Continued downward movement of the upper platen 23, as shown in FIG. 5 of the drawings, causes the lowermost portion 41, 41 of each slitting blade 37, 37 to simultaneously pierce the paper 15 in spaced areas as at 19, 19 in FIG. 7 of the drawings, in order to bgin the slitting operation. This initial piercing of the paper 15 as at 19, 19 in FIG. 7 of the drawings assures a clean and efficient cut or slit being made in the paper as remaining portions of the inclined bottom cutting edge 39 of each slitting blade 37 cooperate with a corresponding complementary slot 43 in the desired slitting action.

After initially piercing the paper as at 19, 19, the remaining unslit portions represented by the phantom lines 21, 21 in FIG. 7 are slit and form the diagonally extending and spaced parallel slits 13, 13 as shown in FIG. 8 of the drawings, for the purposes described above.

As will be appreciated, upon release of the upper platen 23, the resilient and compressible paper hold down and stripper element 51 will continue to hold the paper 15 against the lower platen 25 even after the slitting blades 37, 37 are moved out of the cooperating complementary slots 43, 43 in the lower platen. Thus, no shifting of the paper 15 is permitted as long as the resilient and compressible hold down and stripper element 51 engages the paper 15 in a resilient and compressed condition relative to the lower platen 25. Additionally, the paper 15 is stripped from the cutting blades 37, 37, by the resilient and compressible hold down and stripper element 51, in the event of any hang-up, allowing the paper to be withdrawn from the manually operable paper slitting device 11 without any difficulty.

For proper positioning of the paper 15 in a predetermined orientation relative to the manually operable paper slitting device 11, a rear guide surface 55 is provided in order to allow the rear edge of the paper 15 to be positioned thereagainst for squaring and orienting the paper relative to the upper and lower platens 23, 25. Since the slitting blades 37, 37 and cooperating complementary slots 43, 43 are angularly positioned relative to the paper guide and squaring surface 55, the rear edge of the paper 15 will engage this surface 55, and the diagonally extending and spaced parallel slits 13, 13 will be formed in the paper 15 with the edges of the inserted business card 17 in parallel or perpendicular relationship to the edges of the paper. A variety of types and styles of guide surfaces and/or components may be used in the manually operable paper slitting device 11, as desired.

In the related method of the present invention, the paper 15 to be slit is positioned in aligned and squared orientation relative to a guide surface, such as the guide surface 55 in the manually operable paper slitting device 11. Resilient and compressive hold down forces are then applied on opposite sides of the paper 15 to be slit and in surrounding relationship to the area of the paper to be slit, to facilitate the desired slitting action. Then, the paper is slit along diagonally extending and spaced parallel slits 13, 13 relative to the squared and oriented paper by first piercing and then slitting the paper, as has been discussed in connection with FIGS. 7–8 of the drawings. Thereafter, the paper is stripped from the slitting surfaces following the aforementioned slitting operation. It will be appreciated that the resilient and compressive forces operate to both hold down the paper during the slitting operation and provide stripping from the slitting surfaces following the slitting operation.

In view of the above, it will be seen that the several objects of the invention are achieved, and other advantageous results are obtained.

As various changes could be made in the above constructions and methods without departing from the scope of the invention, it is intended that all matter contained in the above description or shown in the accompanying drawings shall be interpreted as illustrative and not in a limiting sense.

We claim:

1. A manually operable paper slitting device for slitting at least one individual paper sheet comprising:

first and second pivotally mounted platens having spring means interposed therebetween for normally biasing said platens away from each other;

the first platen having spaced slitting blades extending from the first platen toward the second platen and cooperating with spaced complementary slots formed in the second platen when the platens are moved toward each other;

a resilient, elastic and compressible individual paper sheet hold down and stripper element attached to said first platten along its entire platen surface and surrounding the spaced slitting blades in close proximity thereto while also extending from the first platen toward the second platen, said resilient, elastic and compressible paper hold down and stripper element having a height greater than and extending outwardly beyond the spaced slitting blades while also being spaced from the second platen when the first and second platens are in an at-rest position to allow the individual paper sheet to be inserted into the space between the resilient, elastic and compressible paper hold down and stripper element and second platen, said resilient, elastic and compressible paper hold down and stripper element being resiliently and elastically compressed throughout its entire dimensional configuration when a predetermined force is applied to one of said platens to hold the individual paper sheet from moving prior to, during and after the slitting operation while shielding the spaced slitting blades from outside contact at any time; and said spaced slitting blades having an inclined cutting edge at an outermost marginal extend thereof to enable an outermost portion of each slitting blade along said inclined cutting edge to first pierce and then permit remaining portions of each inclined cutting edge to slit the individual paper sheet in conjunction with the cooperating slots formed in the second platen upon the continued application of predetermined force to one of said platens.

2. The manually operable paper slitting device as defined in claim 1 wherein each cooperating slot has an inner edge portion which is contacted by the side of each slitting blade along the inclined cutting edge to provide a combined slitting and shearing action on the individual paper sheet inserted in the device.

3. The manually operable paper slitting device as defined in claim 2 wherein a relieved elongated area surrounding each cooperating slot is formed in the second platen in an undersurface thereof.

4. The manually operable method of forming diagonally extending and spaced parallel slits in at least one individual paper sheet comprising the steps of:

positioning the individual paper sheet to be slit in aligned and squared orientation relative to a guide surface;

applying resilient, elastic and compressive hold-down forces on opposite sides of and throughout the entire dimension of the individual paper sheet to be slit and in surrounding relationship to the area of the paper to be slit prior to, during and after a slitting operations;

slitting the individual paper sheet along diagonally extending and spaced parallel slits relative to said squared and oriented paper by first piercing and then slitting the individual paper sheet beginning adjacent the pierced paper areas and extending along each of said diagonally extending and spaced parallel slits by means of a pair of slitting surfaces; applying resilient, elastic and compressive forces to the individual paper sheet around said slitting surfaces in order to both hold down the individual paper sheet during slitting and provide stripping from the slitting surfaces following slitting of the paper sheet; and stripping the individual paper sheet from the slitting surfaces following the aforementioned slitting operation.

5. The method as defined in claim 4 including the combined step of slitting and shearing the individual paper sheet to provide the aforementioned diagonally extending and spaced parallel slits.

* * * * *